US010927644B2

(12) United States Patent
Atilano et al.

(10) Patent No.: US 10,927,644 B2
(45) Date of Patent: Feb. 23, 2021

(54) SINGLE SIZE ACTUATOR FOR MULTIPLE SLIDING SLEEVES

(71) Applicant: Swellfix B.V., Rijswijk (NL)

(72) Inventors: Christian Atilano, Houston, TX (US); Henry Joe Jordan, Jr., Willis, TX (US); Khai Tran, Pearland, TX (US)

(73) Assignee: Swellfix B.V., Rijswijk (NL)

( * ) Notice: Subject to any disclaimer, the term of this patent is extended or adjusted under 35 U.S.C. 154(b) by 0 days.

(21) Appl. No.: 15/585,513

(22) Filed: May 3, 2017

(65) Prior Publication Data

US 2017/0234107 A1 Aug. 17, 2017

Related U.S. Application Data

(63) Continuation of application No. 14/047,984, filed on Oct. 7, 2013, now abandoned.

(51) Int. Cl.

| | |
|---|---|
| ***E21B 43/10*** | (2006.01) |
| ***E21B 34/10*** | (2006.01) |
| ***E21B 34/06*** | (2006.01) |
| ***E21B 34/14*** | (2006.01) |
| ***E21B 43/14*** | (2006.01) |
| *E21B 43/26* | (2006.01) |

(52) U.S. Cl.

CPC ..... *E21B 34/10* (2013.01); *E21B 34/063* (2013.01); *E21B 34/14* (2013.01); *E21B 43/14* (2013.01); *E21B 43/26* (2013.01); *E21B 2200/06* (2020.05)

(58) Field of Classification Search

CPC .. E21B 2034/007; E21B 21/103; E21B 34/06; E21B 34/063; E21B 34/10; E21B 34/102; E21B 43/14; E21B 43/26; E21B 14/0078; E21B 41/0078; F16K 17/14; F16K 17/16

See application file for complete search history.

(56) References Cited

U.S. PATENT DOCUMENTS

| | | | | |
|---|---|---|---|---|
| 3,358,770 | A * | 12/1967 | Solis | E21B 33/146 137/543.13 |
| 4,360,064 | A * | 11/1982 | O'Connor, III | E21B 34/10 166/319 |
| 6,003,807 | A | 12/1999 | Hagen et al. | |
| 6,457,528 | B1 * | 10/2002 | Staudt | E21B 17/08 166/335 |

(Continued)

OTHER PUBLICATIONS

Invitation to Pay Additional Fees PCT/ISA/206 for International Application No. PCT/EP2014/071469 dated May 21, 2015.

*Primary Examiner* — Christopher J Sebesta
(74) *Attorney, Agent, or Firm* — Harness, Dickey & Pierce, P.L.C.

(57) ABSTRACT

A multiplier sleeve has a releasable seat coupled to a dog within the slidable sleeve allows a single sized ball, dart, or plug to actuate several sliding sleeves. Upon actuation by properly sized ball the ball, slidable sleeve, seat, and dog move downward where the dog is no longer supported allowing the seat to move within the slidable sleeve to a point where the seat is no longer supported thereby releasing the ball. With the slidable sleeve moved downward the port or ports in the sliding sleeve is exposed. A staged port and piston assembly inserted into the ports maintain pressure within the tubular assembly to allow the ball to move through and actuate the targeted sliding sleeves.

12 Claims, 7 Drawing Sheets

(56) References Cited

U.S. PATENT DOCUMENTS

| | | | | |
|---|---|---|---|---|
| 2003/0024706 | A1 | 2/2003 | Allamon | |
| 2006/0196539 | A1* | 9/2006 | Raska | F16K 17/16 137/68.24 |
| 2007/0272420 | A1 | 11/2007 | Retmert et al. | |
| 2009/0218103 | A1* | 9/2009 | Aakre | E21B 34/08 166/373 |
| 2010/0032155 | A1 | 2/2010 | Darnell et al. | |
| 2010/0132954 | A1 | 6/2010 | Telfer | |
| 2011/0030966 | A1 | 2/2011 | Xu | |
| 2011/0030968 | A1* | 2/2011 | Xu | E21B 23/00 166/373 |
| 2011/0067886 | A1* | 3/2011 | Moen | E21B 43/12 166/373 |
| 2011/0083860 | A1* | 4/2011 | Gano | E21B 43/08 166/386 |
| 2011/0106284 | A1 | 5/2011 | Flores et al. | |
| 2012/0037366 | A1* | 2/2012 | Sherman | E21B 34/063 166/297 |
| 2012/0227839 | A1* | 9/2012 | Veit | F16K 15/025 137/538 |
| 2013/0068475 | A1 | 3/2013 | Hofman et al. | |
| 2013/0161015 | A1* | 6/2013 | Campbell | E21B 21/103 166/308.1 |
| 2013/0233564 | A1 | 9/2013 | Pacey | |
| 2014/0102709 | A1 | 4/2014 | Arabskyy | |

* cited by examiner

SINGLE SIZE ACTUATOR FOR MULTIPLE SLIDING SLEEVES

CROSS-REFERENCE TO RELATED APPLICATIONS

This application is a continuation application of U.S. patent application Ser. No. 14/047,984, filed on Oct. 7, 2013, the entire contents of each of which are incorporated herein by reference.

BACKGROUND

In the course of producing oil and gas wells, typically after the well is drilled, the well may be completed. One way to complete a well is to divide the well into several zones and then treat each zone individually.

One method of individually treating multiple sections in a well is to assemble a tubular assembly on the surface where the tubular assembly has a series of spaced apart sliding sleeves. Sliding sleeves are typically spaced so that at least one sliding sleeve will be adjacent to each zone. In some instances annular packers may also be spaced apart along the tubular assembly in order to divide the wellbore into the desired number of zones. In other instances when annular packers are not used to divide the wellbore into the desired number of zones the tubular assembly may be cemented in place.

Typically the tubular assembly is run into the wellbore with the sliding sleeves in the closed position. Once the tubular assembly is in place and has been cemented in place or the packers have been actuated the wellbore may be treated.

One well known wellbore treatment consists of pumping a viscosified fluid containing a proppant at high pressure down through the tubular assembly out of a specified sliding sleeve and into the formation. The high-pressure fluid tends to form cracks and fissures in the formation allowing the viscosified fluid to carry the proppant into the cracks and fissures. When the treatment ends, the proppant remains in the cracks and fissures holding the cracks and fissures open and allowing wellbore fluid to flow from the formation zone, through the open sliding sleeve, into the tubular assembly, and then to the surface.

To open a sliding sleeve, an obturator, such as a ball, a dart, etc., is dropped into the wellbore from the surface and pumped through the tubular assembly. The obturator is pumped through the tubular assembly to the sliding sleeve where it lands on the seat of the sliding sleeve and forms a seal with the seat on the sliding sleeve to block further fluid flow past the ball and the seat. As additional fluid is pumped into the well the differential pressure formed across the seat and ball provides sufficient force to move the sliding sleeve from its closed position to its open position. Fluid may then be pumped out of the tubular assembly and into the formation so that the formation may be treated.

In order to selectively open a particular sliding sleeve the obturator may be sized so that it will pass through multiple sliding sleeves until finally reaching the sliding sleeve where the seat size matches the size of the obturator. In practice the sliding sleeve with the smallest diameter seat is located closest to the bottom or toe of the well. Each sliding sleeve above the lowest sliding sleeve has a seat with a diameter that is slightly larger than the seat below it. By using seats that step up in size as they get closer to the surface, a small diameter obturator may be dropped into the tubular assembly and will pass through each of the larger diameter seats on each sliding sleeve above the lowest sliding sleeve. The obturator finally reaches the sliding sleeve with a seat diameter that matches the diameter of the obturator. The obturator and seat block the fluid flow past the sliding sleeve actuating the particular sliding sleeve.

Progressively larger obturators are launched into the tubular assembly to selectively open each sliding sleeve. Each seat and obturator must be sized so that the seat provides sufficient support for the obturator at the anticipated pressure. Due to the increasing size of the obturators and seats there seems to be an upper limit on the number of sliding sleeves that may be utilized in a single well thereby limiting the productivity of the well. An additional limitation of the current technology is that by utilizing progressively smaller seats towards the bottom of the well the productivity of the well is further limited as each seat chokes fluid flow from the bottom of the well towards the top of the well. Therefore in practice there is usually the additional step of drilling out the seats adding further costs to completing the well.

SUMMARY

One solution to the problem of the upper limit on the number of sliding sleeves that may be utilized in a single well is to use a multiplier sleeve that allows a single obturator to activate multiple sliding sleeves. In one embodiment an obturator will be launched into the well. The obturator will land upon the targeted seat in a particular multiplier sleeve. As pressure builds, the seat will exert pressure upon a dog that is coupled to both the seat and to the inner sleeve. At some point a shear pin will shear allowing the inner sleeve, seat, and dog to move downward towards the toe of the well. At some point a port in the housing of the multiplier sleeve will be exposed. However fluid pressure in the interior of the multiplier sleeve is blocked from passing through the port by a disc and piston assembly. The disc and piston maintain fluid pressure within the interior of the multiplier sleeve. At some preselected pressure level the fluid pressure will act upon the piston through a nozzle in the disc forcing the piston out of the port so that fluid may flow through the nozzle and into the formation. With the port in the housing of the multiplier sleeve exposed, the dog also reaches a position where a relief has been cut into the interior wall of the housing to allow the dog to radially expand outward thereby releasing the seat to move longitudinally within the inner sleeve. As the fluid pressure continues to act across the obturator and seat, the seat is forced downward within the inner sleeve. The seat reaches a position where a relief has been cut into the interior wall of the inner sleeve to allow the seat to radially expand outward thereby releasing the obturator to move through the multiplier sleeve to the next targeted multiplier sleeve.

In one embodiment of the multiplier sleeve, the multiplier sleeve may have a seat in a first position with a first diameter. A dog may be coupled to the seat. In a first position the dog prevents the seat from longitudinal movement within an inner sleeve and in a second position allows the seat to move longitudinally within the inner sleeve. The seat in a second position has a second diameter. The inner sleeve has a first position within a housing wherein the dog is supported by the housing in the dog's first position. The inner sleeve has a second position within a housing wherein the dog is supported by a relief in the housing in the dog's second position. The seat is coupled to an anti-reverse tubular and the coupling between the seat and the anti-reverse tubular is ratcheted. The anti-reverse tubular has an anti-rotation ring and the inner sleeve has a stop tab and upon rotation the coupling between the seat and the anti-reverse tubular is tightened.

A method of utilizing an embodiment of a multiplier sleeve has the sleeve moving from a first position to a second position. The dog is disengaged from a seat within the inner sleeve to allow the seat to move from a first position to a second position within the inner sleeve and upon the seat reaching the second position the seat is radially expanded from a first diameter to a second diameter. The inner sleeve has a first position within a housing wherein the dog is supported by the housing in the dog's first position and the inner sleeve has a second position within a housing wherein the dog is supported by a relief in the housing in the dog's second position. A shear pin, screw, C ring, or other lock is sheared to allow the sleeve to move from the first position to the second position. The seat is coupled to an anti-reverse tubular and the coupling between the seat and the anti-reverse tubular is ratcheted. The anti-reverse tubular has an anti-rotation ring and the inner sleeve has a stop tab. Upon rotation the coupling between the seat and the anti-reverse tubular may be tightened.

An embodiment of the port restrictor has a port in a housing. A disc is fixed within the port and has a nozzle extending through it. A piston may be fixed within the port radially outward from a center of the housing of the disc. The disc may be threaded or pinned within the port. The piston may be threaded or pinned to the port or to the disc by shearable threads or pins. In many instances the piston may have a slot or slots across the surface of the piston is adjacent to the disc.

A method of utilizing an, embodiment of a multiplier sleeve has the sleeve moving from a first position to a second position to expose a port in the housing. Fluid may then pass through a nozzle in the disc to act upon the piston radially outward and adjacent to the disc. The fluid pressure shears the pins or other shareable device that retain the piston in the port, thereby removing the piston from the port. The dog is disengaged from a seat within the inner sleeve to allow the seat to move from a first position to a second position within the inner sleeve and upon the seat reaching the second position the seat is radially expanded from a first diameter to a second diameter. The inner sleeve has a first position within a housing wherein the dog is supported by the housing in the dog's first position and the inner sleeve has a second position within a housing wherein the dog is supported by a relief in the housing in the dog's second position. A shear pin, screw, C ring, or other lock is sheared to allow the sleeve to move from the first position to the second position. The seat is coupled to an anti-reverse tubular and the coupling between the seat and the anti-reverse tubular is ratcheted. The anti-reverse tubular has an anti-rotation ring and the inner sleeve has a stop tab. Upon rotation the coupling between the seat and the anti-reverse tubular may be tightened.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The description that follows includes exemplary apparatus, methods, techniques, and instruction sequences that embody techniques of the inventive subject matter.

Figure 1:
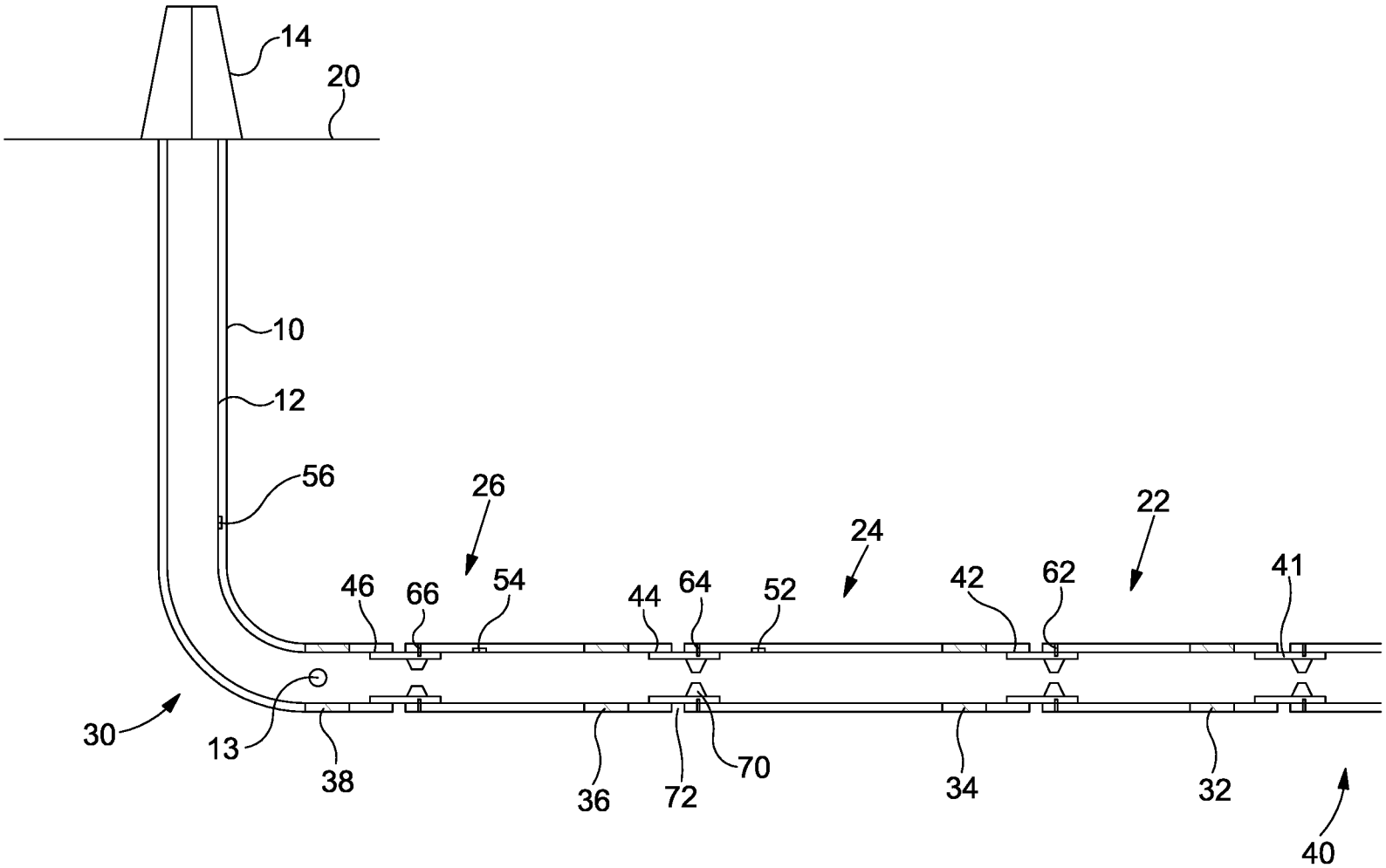
FIG. 1 depicts a completion where a wellbore has been drilled through one or more formation zones and has a tubular assembly within the wellbore.

FIG. 1 depicts a completion where wellbore 10 has been drilled through one or more formation zones 22, 24, and 26. A tubular assembly 12, consisting of casing joints, couplings, annular packers 32, 34, 36, and 38, multiplier sliding sleeves 42, 44, and 46, that are initially pinned in place in the closed position by shear pins 62, 64, and 66, and has been run into the wellbore 10. The well 10, if it is a horizontal or at least a non-vertical well, may have a heel 30 and at its lower end will have a toe 40.

Typically the casing assembly 12 is made up on the surface 20 and is then lowered into the position 10 by the rig 30 until the desired depth is reached so that multiplier sliding sleeves 42, 44, and 46 are adjacent formation zones 22, 24, and 26. In many instances there may be a plurality of sliding sleeves adjacent to any single formation zone, such as formation zones 22, 24, and 26. The annular packers are arranged along the tubular assembly so that annular packer 32 is placed below formation zone 22 and annular packer 34 is placed above formation zone 22 and both annular packers 32 and 34 are actuated to isolate formation zone 22 from all of the zones in the well 10. Annular packer 34 is placed so that while it is above formation zone 22 is below formation zone 24 and annular packer 36 is placed above formation zone 24 and both annular packers 34 and 36 are actuated to isolate formation zone 24 from all other zones in the well 10. Annular packer 36 is placed so that while it is above formation zone 24 is below formation zone 26 and annular packer 38 is placed above formation zone 26 and both annular packers 36 and 38 are actuated to isolate formation zone 26 from all other zones in the wellbore 10. While the wellbore 10 is depicted in FIG. 1 as using casing annular packers to isolate the formation zones in many instances the casing assembly 12 may be cemented in place to provide zonal isolation.

In operation an obturator 13 is dropped or inserted into the fluid flow at the surface. The obturator 13 may be a ball, dart, plug, or any other device that may be inserted into the fluid flow to actuate a specific sliding sleeve or group of sliding sleeves such as the multiplier sleeves. The obturator 13 is sized so that as the obturator 13 progresses through the casing assembly 12 the obturator 13 will pass through any sliding sleeves or multiplier sleeves such as sliding sleeve 46 that may be positioned above the targeted multiplier sleeves 44 and 42 without actuating the non-targeted sliding sleeve 46. Upon reaching the first targeted multiplier sleeve 44 the obturator 13 will land on the seat 70 and as pressure increases across the seat 70 and obturator 13 shear pin 64 will shear allowing sliding sleeve 44 and seat 70 to move towards the toe 40 of the wellbore 10 exposing port 72. Initially port 72 is blocked by a first disc and piston assembly (not shown). With the port 72 exposed fluid pressure will act upon the first disc and piston assembly to open a flowpath from the interior of the casing assembly 12 to the formation zone 24. As the sliding sleeve 44 and seat 70 and towards the toe 40 the seat 70 will release the obturator 13 to allow it to continue on to the next targeted multiplier sleeve 42 were the actuation process is repeated and eventually the obturator 13 is released to continue on to the final targeted sliding sleeve 41 where the sliding sleeve 41 is moved towards the toe 40 to expose the port 43 but in this instance the obturator 13 is not released from the seat 45 so that targeted formation zones 22, 23, and 24 or portions of formation zone may be treated.

Figure 2:
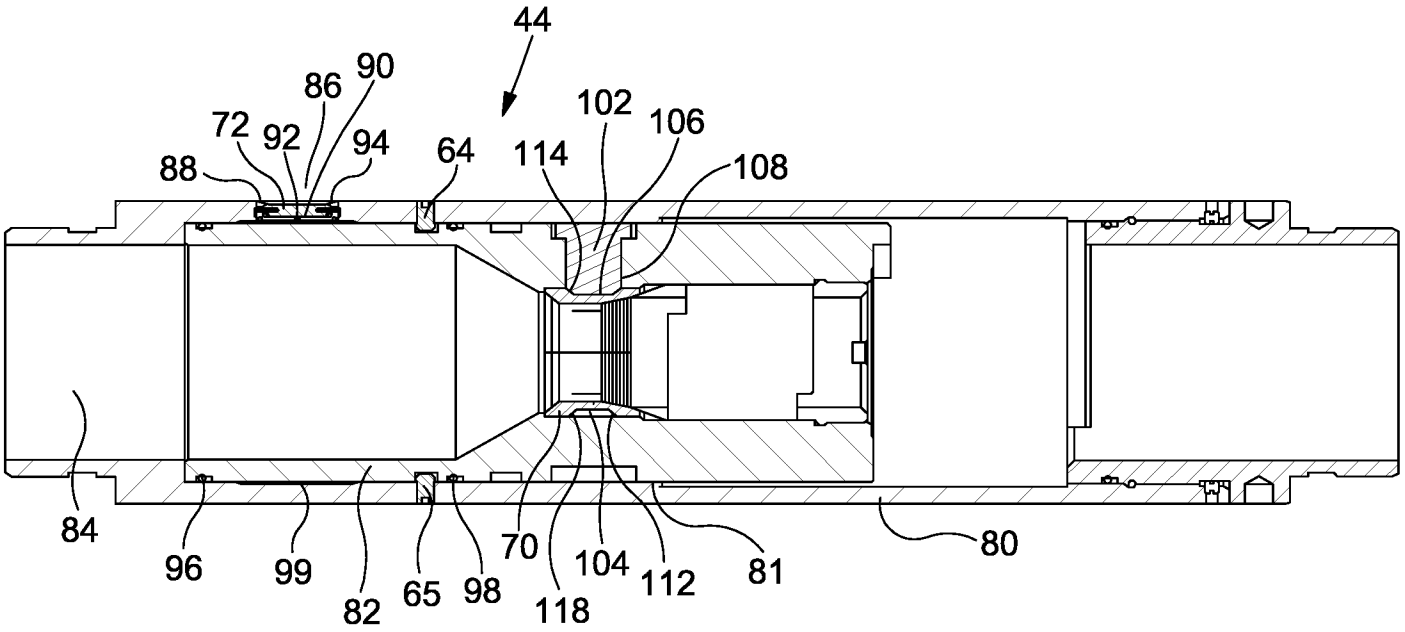
FIG. 2 depicts a multiplier sleeve in its closed position.

FIG. 2 depicts a multiplier sleeve such as multiplier sleeve 44 in its closed position. The multiplier sleeve 44 has an outer housing 80 and an inner sleeve 82. The outer housing 80 has at least one port 72 through it to allow fluid access from the interior 84 of the multiplier sleeve 44 to the exterior 86. The inner sleeve 82 is held in place by shear pins 64 and 65 while first seal 96 and second seal 98 prevent fluid from flowing around the inner sleeve 82 to port 72. On the interior surface 81 of the housing 80 adjacent port 72 a relief 99 may be milled into interior surface 81 of the housing 80 so that seal 96 may slide across the port 72 without damage. The relief 99 also tends to reduce friction between the seal 96 and the housing 80 when the inner sleeve 82 is shifted. In its run in or closed condition, the port 72 has a first disc 88 threaded into the port 72.

While usually the first disc 88 is threaded into port 72 any means of securing the first disc 88 into the port 72 such as welding, shear pins, press fitting, or any other means known in the industry may be used to secure the first disc 88 in the port 72. Usually the method used to secure the first disc 88 in the port 72 will include a fluid tight seal such as an O-ring or metal to metal seal. Typically while the first disc 88 has a fluid tight seal around the exterior the first disc 88 has a hole 92 through the first disc 88 usually near its center. A piston 90 is secured adjacent to the first disc 88 in a manner that causes a fluid tight seal between the first disc 88 and the piston 90. The piston 90 may be secured adjacent the first disc 88 by shear pins 94, or by any other means known in the industry, so that when sufficient pressure is applied through hole 92 in first disc 88 against the bottom of the piston 90 the shear pins 94 will shear allowing the fluid pressure to remove the piston 90 from blocking fluid flow through hole 92. While the piston 90 in shown being positioned in a cutout in first disc 88 the piston 90 may be secured adjacent first disc 88 by securing the piston 90 directly to the sides of port 72 in housing 80.

In the multiplier sleeve's 44 run in condition the dog 102 is supported by the interior surface 81 of the housing 80. In turn the seat 70 is supported by at least one dog 102. The seat 70 has a radially exterior profile 104 that operatively matches the radially interior profile 106 on the dog 102 where the toe end 108 of profile 106 matches the toe end 112 of the seat 104 and the heel end 114 of the profile 106 matches the heel end 118 of the seat 104. The angles between the toe end 108 and the toe end 112 as well as between the heel end 114 and the heel end 118 may be selected to allow linear downward (towards the toe) motion of the seat 70 to be transferred to the dog 102 as a radially outward force. The profiles between the seat 70 and the dog 102 may be angles, curves, or any other shape that allows a linear downwards force to be redirected in a radially outwards direction.

Figure 3:
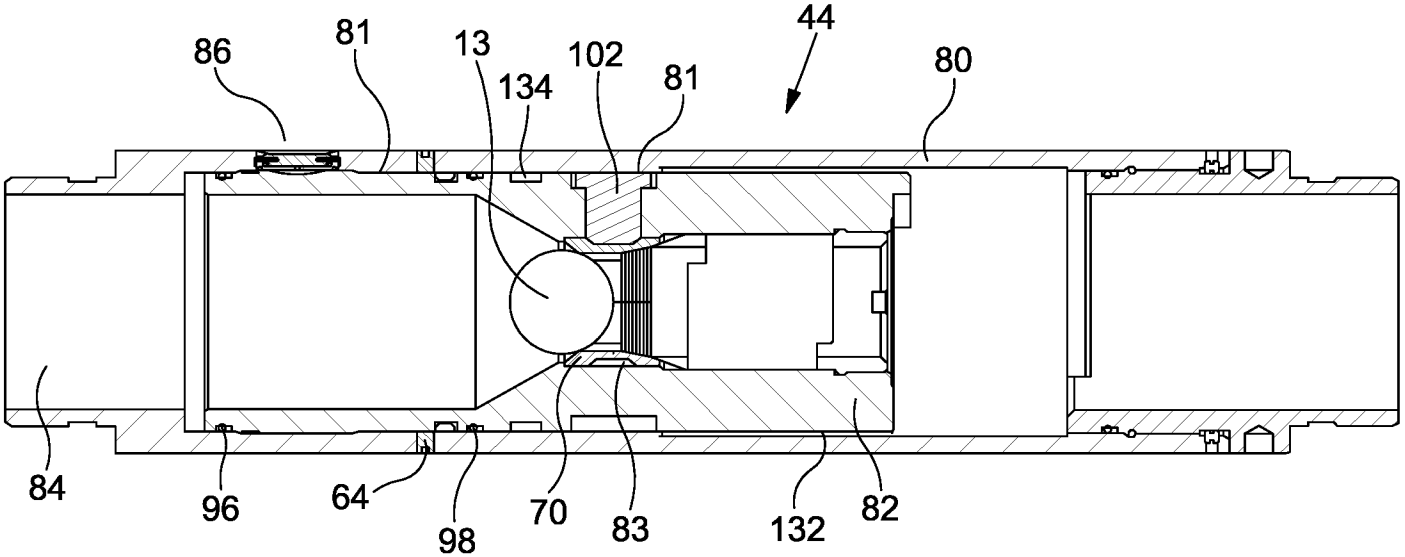
FIG. 3 depicts the multiplier sleeve just after the obturator lands on the seat.

FIG. 3 depicts the multiplier sleeve 44 just after the obturator 13 lands on seat 70. Fluid pressure from the surface 20 ask across the obturator 13, the seat 70, and a portion of the inner sleeve 82 to shear the shear pins 64 thereby allowing the inner sleeve 82 to begin moving towards the toe 40 of the wellbore 10. As depicted in FIG. 3, even though the inner sleeve 82 has moved some distance towards the toe 40 of the wellbore 10 first seal 96 and second seal 98 continue to provide a fluid seal between the interior 84 of the multiplier sleeve 44 and the exterior 86 of the multiplier sleeve 44. The dog 102 remains supported by the interior surface 81 of the housing 80 in turn the dog 102 continues to prevent the seat 70 from moving longitudinally in relation to the inner sleeve 82. Seat 70 is radially supported by interior surface 83 of the inner sleeve 82. Additionally, the anti-reverse ring 134 is also supported by the interior surface 81 of the housing 80 thereby remaining in a non-actuated configuration.

Figure 4:
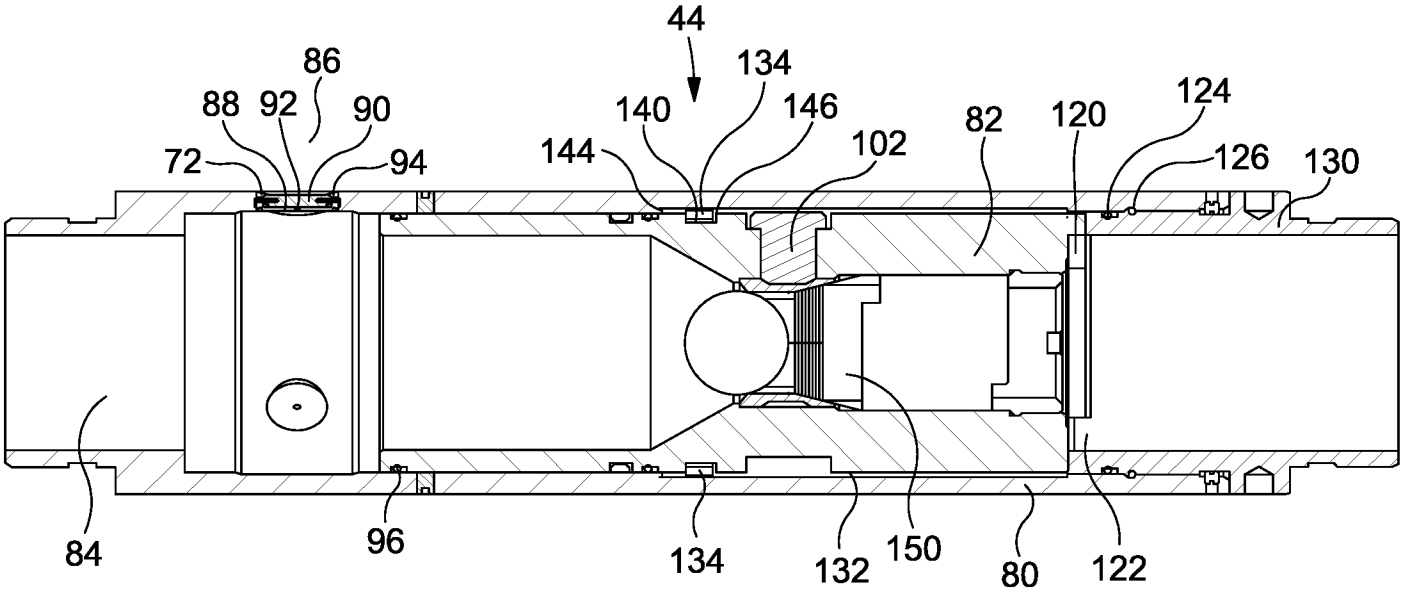
FIG. 4 depicts the multiplier sleeve with the inner sleeve shifted to its fully open position.

FIG. 4 depicts the multiplier sleeve 44 with the inner sleeve 82 shifted to its fully open position so that the anti-rotation tab 120 on the inner sleeve 82 is in position so that in the event that the inner sleeve 82 rotates within the housing 80 the anti-rotation tab 120 on the inner sleeve 82 will contact the stop tab 122 on the second housing 130. As depicted the second housing 130 is threaded into housing 80 with seals 124 and 126 to prevent fluid pathways between the interior 84 of the multiplier sleeve 44 and the exterior 86 of the multiplier sleeve 44. While second housing 130 is depicted as being threaded into the housing 80 the second housing 130 and the housing 80 could be welded together, they could be machined as a single unit, the housing 80 could be threaded into the second housing 130, they could be pinned together, or they could be attached by any means known in the industry. With the inner sleeve 82 shifted to its fully open position both the anti-reverse ring 134 and the dog 102 are moved to a second relief 132 are formed in the housing 80 and are no longer supported in their initial positions by the interior surface 81 of the housing 80. Once the anti-reverse ring 134 moves into the second relief 132 anti-reverse ring 134 may expand radially outward into the second relief 132. The anti-reverse ring 134 is sized such that after the anti-reverse ring 134 expends radially outward into the second relief 132 at least a portion of the anti-reverse ring 134 will remain within slot 140 and the inner sleeve 82 so that in the event that inner sleeve 82 begins to move towards the heel 30 of wellbore 10, the anti-reverse ring 134 engages first shoulder 144 on the housing 80 and second shoulder 146 on the inner sleeve 82 preventing further movement by the inner sleeve 82 towards the heel 30 of the wellbore 10.

With the inner sleeve 82 shifted to its fully open position seal 96 is moved from its position above port 72 to below port 72 thereby exposing the first disc 88 disposed in port 72 to the fluid in the interior 84 of the multiplier sleeve 44. The fluid through hole 92 may exert pressure against the piston 90. When sufficient pressure is present shear pins 94 will release the piston 90 to allow fluid to flow through the whole 92 to the exterior 86.

Figure 5:
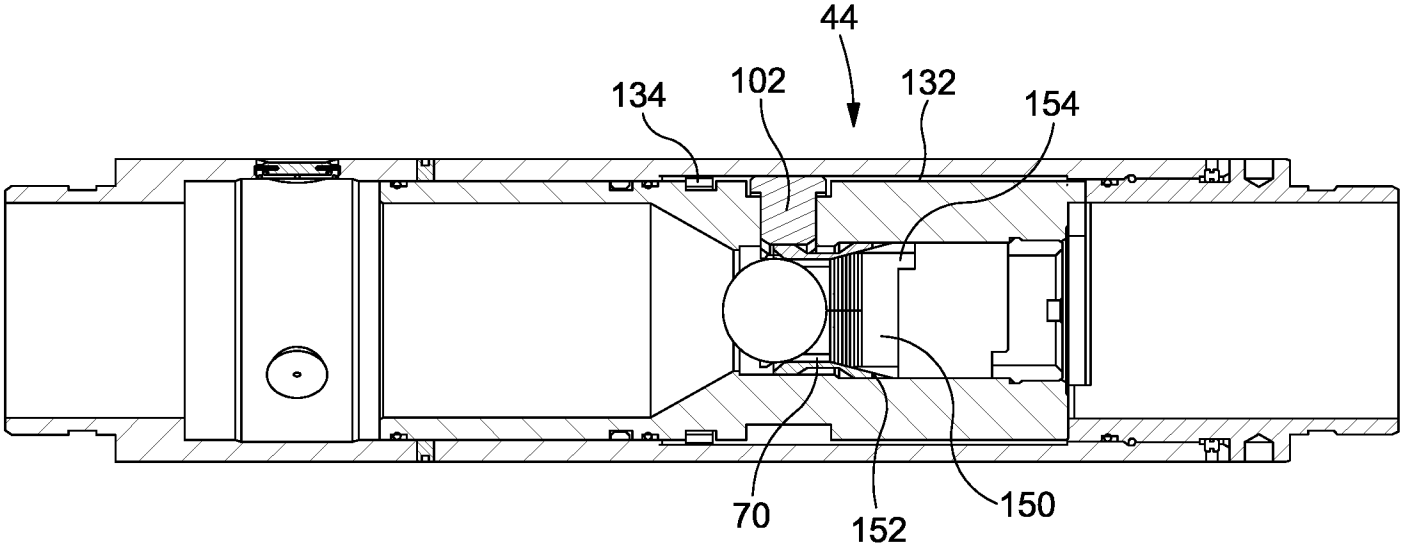
FIG. 5 depicts the multiplier sleeve as the seat is released to begin moving downward towards the toe of the wellbore with an anti-reverse device.

FIG. 5 depicts the multiplier sleeve 44 with the anti-reverse ring 134 expanded radially outward into the second relief 132 and with dog 102 also expanded radially outward into the second relief 132. With the dog 102 expanded radially outward the seat 70 is released to begin moving downward towards the toe 40 of the wellbore 10. As the seat 70 moves downward the seat carries with it an anti-reverse device 150. The seat 70 and the anti-reverse device 150 are coupled together at interface 152 by ratcheting rings or threads that may or may not be ratcheted. Anti-reverse device 150 includes an anti-rotation tab 154.

Figure 6:
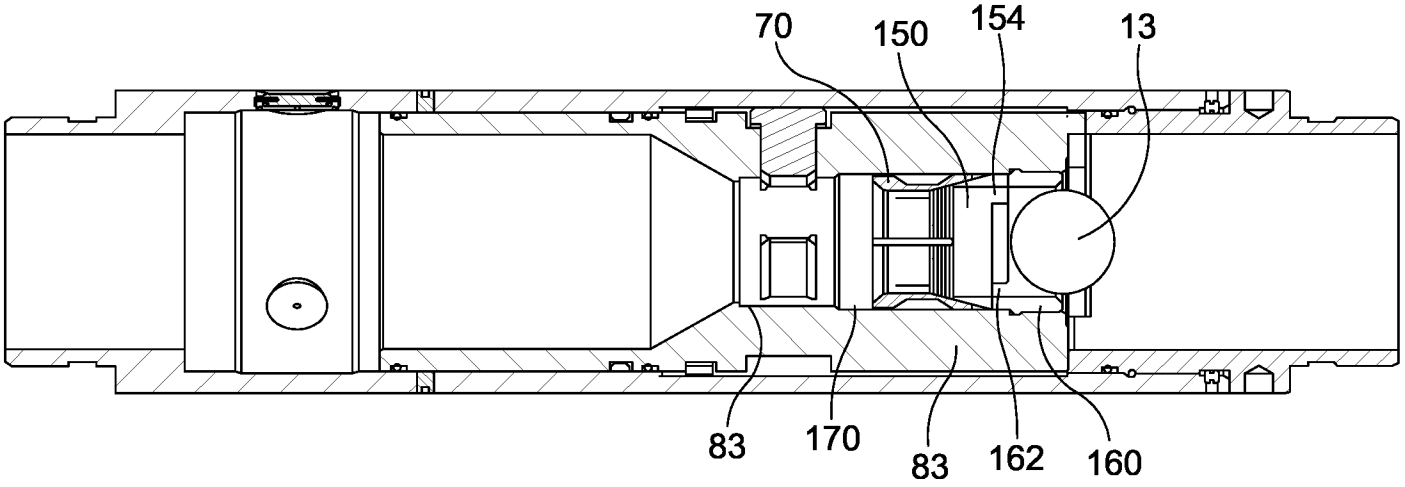
FIG. 6 depicts the seat and its coupled anti-reverse device moved to the anti-reverse devices stop position.

FIG. 6 depicts the multiplier sleeve 44 with the seat 70 and its coupled anti-reverse device 150 moved to its stop position against insert 160. Insert 160 serves to halt the longitudinal movement of the anti-reverse device 150 and the seat 70 towards the toe 40 of the wellbore 10. In addition insert 160 has a stop tab 162. In the event that the seat 70 and the anti-reverse device 150 begin to rotate anti-rotation tab 154 will engage against the stop tab 162 to prevent the anti-reverse device 150 from rotating. Preferably the seat 70 and the anti-reverse device 150 are coupled together at interface 152 by ratcheting left-hand threads. During mill out with right-hand rotation the left-hand threads at interface 152 causes the seat 72 threaded onto the anti-reverse device 150 becoming tighter or more difficult to turn as right-hand rotation continues, eventually the seat 70 can no longer be tight on to anti-reverse device 150 and may be milled out. Insert 160 may be threaded or otherwise coupled to inner sleeve 82.

As seat 70 moves downward, the seat 70 moves to relief 170 that is formed on an interior surface of inner sleeve 82. Once the seat 70 moves to relief 170 the seat 70 is no longer radially supported by interior surface 83 and may move radially outward to release obturator 13. The seat 70 may be formed from a single piece of material where the single piece of material may be slotted, may be frangible, or may be made from multiple pieces of material that are retained by spring an elastomer or the interior surface of the inner sleeve 82 as long as the circumferential expansion of the sleeve 70 caused by the sleeve moving radially outward is provided for so that obturator 13 may be released. Typically as the obturator 13 radially expands the seat 70 the seat 70 will be forced downward in outward over anti-reverse device 150. The ratcheting threads at interface 152 prevent the seat 70 from returning to its initial diameter thereby allowing the obturator 13 to flowing out of the wellbore 10 as the formations 22, 24, and 26 are produced.

Figure 9:
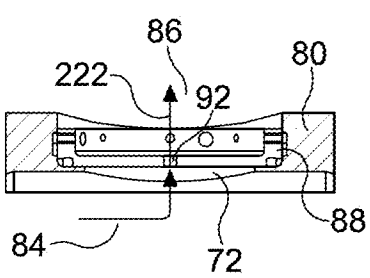
FIG. 9 depicts the first disc secured within the port as fluid flow moves from the interior to the exterior of the housing.
Figure 8:
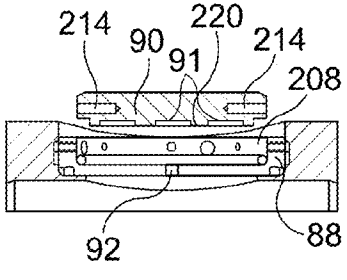
FIG. 8 depicts first disc after sufficient fluid pressure has been exerted through the hole to release piston.
Figure 7:
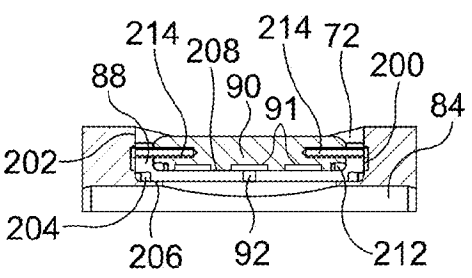
FIG. 7 depicts the first disc and piston inserted in the port with the inner sleeve fully open.

FIGS. 7, 8, and 9 are close-ups of the port 72. FIG. 7 depicts a first disc 88 and piston 90 inserted in the port 72 with inner sleeve 82 fully open. As depicted in FIG. 7 first disc 88 has threads 200 that engage with the port side walls 202 that fix the first disc 88 in place within the port 72. The first disc 88 is threaded into the port 72 so that seal 204 is captured between shoulder 206 and first disc 88 to form a fluid seal between the shoulder 206 and the first disc 88 thereby limiting fluid flow from the interior 84 of the multiplier sleeve 44 to the hole 92. Further fluid flow through the first disc 88 is then blocked by piston 90. As depicted piston 90 is inserted into a recess 208 formed in first disc 88. Piston 90 is inserted into recess 208 so that seal 212 is captured between first disc 88 and piston 90 to block fluid flow through hole 92. Piston 90 may have slots formed in its radially inward surface 220 (for example, the slots 91 shown in FIGS. 7 and 8) so that fluid flowing through hole 92 may be distributed across the radially inward surface 220 of the piston 90, such that a flow direction of the fluid distributed across the radially inward surface 220 of the piston 90 is different in relation to a flow direction of the fluid flowing through the hole 92. Piston 90 may be fixed to first disc 88 by shear pins such as shear pins 214. In practice the first disc 88 and piston 92 assembly may be assembled prior to being inserted into port 72. In certain instances the first disc 88 may be pressed into port 72 or may be machined into the housing 80 as part of port 72. The piston may then be threaded, pressed, or otherwise fixed in place adjacent to first disc 88 without necessarily being inserted into a recess such as recess 208 in the first disc 88.

As depicted in FIG. 8 sufficient fluid pressure has been exerted through hole 92 in first disc 88 and across the radially inward surface 220 to shear the shear pins 214 thereby releasing the piston 90 from recess 208 in first disc 88. FIG. 9 depicts first disc 88 secured within port 72 as fluid flow, depicted by arrows 222, is allowed to move from the interior 84 to the exterior 86 of the housing 80.

Figure 11:
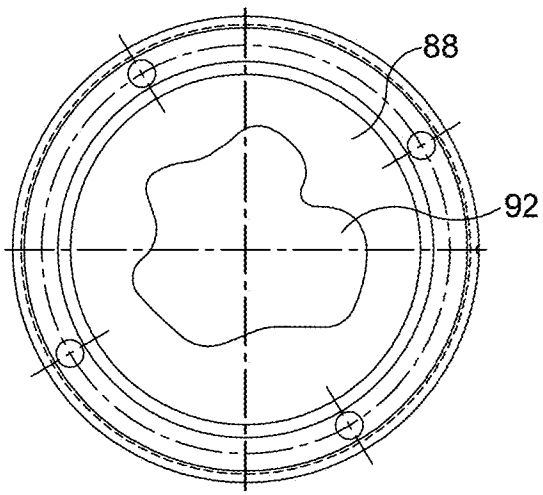
FIG. 11 depicts the first disc after fluid has been flowing from the interior to the exterior of the housing enlarging the hole over time.
Figure 10:
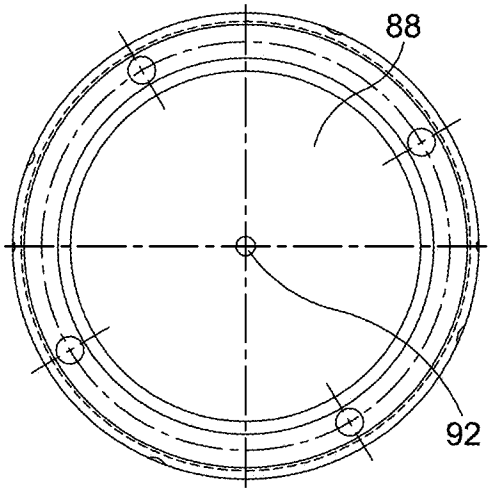
FIG. 10 depicts a top view of the first disc with a hole through the center of first disc but after the piston has been released.

FIG. 10 depicts a top view of first disc 88 having hole 92 through the center of first disc 88 but after piston 90 has been released. FIG. 11 depicts first disc 88 having an enlarged hole 92. In many instances depending upon the material used to construct first disc 92 as the fluid flows from the interior 84 to the exterior 86 of the housing 80 through hole 92 the material will be worn away enlarging hole 92 over time.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

While the foregoing is directed to embodiments of the present invention, other and further embodiments of the invention may be devised without departing from the basic scope thereof, and the scope thereof is determined by the claims that follow.

What is claimed is:

1. A port restrictor in a downhole device, the port restrictor permitting non-checked, bidirectional fluid flow and comprising:

a port in a housing;

a disc fixed within the port, wherein the disc has a nozzle extending through it; and a piston fixed within the port radially outward of the disc and including a plurality of slots formed in a surface of the piston that is adjacent to the disc so that fluid flowing through the nozzle is distributed across the surface of the piston that is adjacent to the disc such that a flow direction of the fluid distributed across the surface of the piston that is adjacent to the disc is different in relation to a flow direction of the fluid flowing through the nozzle;

wherein the piston of the port restrictor is configurable to initially seal the port in the housing, and to be released and ejected from the port of the port restrictor when pressure is exerted on the piston of the port restrictor through the nozzle in the disc to enable both injection and subsequent production of a downhole fluid through the port of the port restrictor.

2. The port restrictor of claim 1 wherein, the disc is threaded to the port.

3. The port restrictor of claim 1 wherein, the disc is pinned to the port.

4. The port restrictor claim 1 wherein, the piston is threaded to the port.

5. The port restrictor claim 1 wherein, the piston is pinned to the disc via pins.

6. The port restrictor of claim 5 wherein, the pins are shear pins.

7. A method for activating a downhole device having a port restrictor of claim 1, the method comprising:

moving an inner sleeve from a first position to a second position, wherein the port in the housing of the port restrictor is exposed, the port in the housing being initially sealed by the port restrictor;

flowing a first fluid through the nozzle of the disc of the port restrictor;

releasing and ejecting the piston of the port restrictor radially outward of the disc, wherein the plurality of slots formed in the surface of the piston that is adjacent to the disc are formed such that the first fluid flowing through the nozzle is distributed across the surface of the piston that is adjacent to the disc such that a flow direction of the first fluid distributed across the surface of the piston that is adjacent to the disc is different in relation to a flow direction of the first fluid flowing through the nozzle;

disengaging a dog from a seat within the inner sleeve; moving the seat from a first position to a second position within the inner sleeve; and radially expanding the seat from a first diameter to a second diameter.

8. The method of claim 7 wherein, when the inner sleeve is in the first position, the dog is supported by the housing in a first position of the dog.

9. The method of claim 7 wherein, when the inner sleeve is in the second position, the dog is supported by a relief in the housing in a second position of the dog.

10. The method of claim 7 further comprising:

shearing a lock to allow the inner sleeve to move from the first position to the second position.

11. The method of claim 7 wherein, the seat is coupled to an anti-reverse tubular to prevent movement of the seat in the inner sleeve towards a previous position, wherein the coupling between the seat and the anti-reverse tubular is ratcheted.

12. The method of claim 11 wherein, the anti-reverse tubular has an anti-rotation ring and the inner sleeve has a stop tab.

* * * * *